US006890207B2

(12) United States Patent
Kobayashi

(10) Patent No.: US 6,890,207 B2
(45) Date of Patent: May 10, 2005

(54) CONNECTOR AND ELECTRONIC DEVICE AND INFORMATION PROCESSING APPARATUS USING SAID CONNECTOR

(75) Inventor: Akihiko Kobayashi, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 38 days.

(21) Appl. No.: 10/247,280

(22) Filed: Sep. 20, 2002

(65) Prior Publication Data

US 2003/0064621 A1 Apr. 3, 2003

(30) Foreign Application Priority Data

Oct. 2, 2001 (JP) ..... 2001-306536

(51) Int. Cl.[7] ..... H01R 13/64
(52) U.S. Cl. ..... 439/374; 439/76.1
(58) Field of Search ..... 439/374, 76.1

(56) References Cited

U.S. PATENT DOCUMENTS 4,780,793 A 10/1988 Ohtsuki ..... 361/756
5,580,268 A 12/1996 Miyazawa ..... 439/352
6,109,940 A 8/2000 Chad et al. ..... 439/141
6,139,338 A 10/2000 Hirai et al. ..... 439/141
6,328,588 B1 * 12/2001 Tsai et al. ..... 439/352
6,413,108 B2 7/2002 Centofante ..... 439/267

FOREIGN PATENT DOCUMENTS

JP 6-139415 5/1994
JP 1-91579 6/1998
JP 2001-43339 8/2002

* cited by examiner

*Primary Examiner*—Gary Paumen
(74) *Attorney, Agent, or Firm*—Fitzpatrick, Cella, Harper & Scinto

(57) ABSTRACT

A removable electronic device includes an enclosure and connector device, wherein the connector device has a connector device guide formed on each of two sides of the connector device. The enclosure has an enclosure guide, which is in a shape generally continuous with the connector device guide, formed on each of two sides thereof.

7 Claims, 7 Drawing Sheets

CONNECTOR AND ELECTRONIC DEVICE AND INFORMATION PROCESSING APPARATUS USING SAID CONNECTOR

BACKGROUND OF THE INVENTION

1. Field of the Invention

The present invention relates to a connector, electronic device and information processing apparatus, and particularly to a connector mounted to an electronic device, and to an electronic device and information apparatus that incorporate an electronic component, e.g., storage media such as a hard disk and semiconductor memory, and are detachably attachable to a main apparatus such as a personal computer.

2. Related Background Art

A conventional electronic device of this type is now described with reference to FIG. 9 to FIG. 12.

Referring to FIG. 9, which shows a perspective view of a conventional electronic device, an electronic device 100 is comprised of an enclosure 102 including an electronic component (not shown), and a connector 101 electrically connected to the electronic component and disposed on a side of the enclosure.

An enclosure 102 has a right guide 102*a* and left guide 102*b* on either side, and the connector 101 has a connection terminal 101*a* electrically connected to a corresponding connector, as well as a right boss 101*b* and left boss 101*c* for aligning with the corresponding connector.

As shown in FIG. 9, the connector 101 of the conventional electronic device 100 is smaller in vertical and horizontal outer dimensions than the electronic device enclosure 102, and four sides forming a terminal plane for connecting the connector 101 are not exposed outside the electronic device 100. That is, the connector 101 is constructed so that four sides thereof are covered by the enclosure 102.

In an example shown in FIG. 9, the right guide 102*a* and left guide 102*b* are presented in the shape of a groove.

FIG. 10 is a perspective view showing the electronic device 100 that is inserted through a slot of an electronic device connecting apparatus located on the main apparatus.

In FIG. 10, reference numerals 200, 200*a*, 200*b*, and 300 denote an electronic device connecting apparatus, an external enclosure of the electronic device connecting apparatus, a slot for the electronic device 100, and an electronic device support component within the electronic device connecting apparatus 200, respectively.

As shown in FIG. 10, the electronic device 100 is oriented toward the electronic device connecting apparatus 200 in a side of the connector 101, inserted through the slot 200*a*, and then inwardly moved while it is supported by the electronic device support component 300.

FIG. 11 shows how the electronic device 100 is supported by the electronic device support component 300.

It shows in perspective the external enclosure 200*a* in FIG. 10, and shows a perspective representation of the electronic device support component 300.

FIG. 11 shows a right support guide and left support guide, 300*a* and 300*b* respectively, of the electronic device support component 300, a connector 400 on the electronic device connecting apparatus, a main electrical circuit board 401 of the electronic device connecting apparatus, and an electrical component 402 mounted on the main electrical circuit board.

Once the electronic device 100 is inserted into the electronic device support component 300, the right support guide 300*a* is engaged with the groove of the right guide 102*a* and the left support guide 300*b* with the groove of the left guide 102*b*, the electronic device 100 is then supported in vertical and horizontal directions in relation to the electronic device support component 300 to be inwardly moved.

FIG. 12 shows a perspective view of a connector 400 located on the electronic device connecting apparatus 200 and connected to the connector 101 of the electronic device 100, and reference numerals 400*b* and 400*c* denote right and left recesses respectively, and 400*a* denotes a connection terminal of the connector 400.

The connector 100 is shown aligned in vertical and horizontal directions in relation to the connector 400 by engaging the right boss 101*b* with the right recess 400*b* and the left boss 101*c* with the left recess 400*c* before or once the connector 100 is connected to the connector 400, so that the connectors are connected to each other.

Because the connector 101 is constructed so that four sides thereof are covered by the enclosure 102 as describe above, supporting the enclosure 102 of the electronic device 100 by the electronic device support component 300 with the respective guide before connectors are connected to each other after the electronic device 100 is inserted, and supporting the connector 101 and connector 400 with each other before making connection, may not allow the connector 101 to be aligned with the connector 400 in the vertical and horizontal directions even when the enclosure 102 is properly supported to align in place by the electronic device support component 300 before making connection, due to the difficulty of centering the connector 101 on the enclosure 102 with a clearance caused by tolerances between each other.

The connectors, therefore, collide with each other, in particular, the right and left bosses, 101*b* and 101*c*, of the connector 101 may not be inserted into the right and left recesses, 400*b* and 400*c*, of the connector 400.

By tapering or radiusing each edge of the right and left bosses, 101*b* and 101*c*, and each inlet of the right and left recesses, 400*b* and 400*c*, positions of misaligned connectors may be forced to match. In that case, however, loads and/or stresses on each connector or associated components with the connectors have caused problems such as fatigue failure.

To address these problems, conventional types of the electronic device and electronic device connecting apparatus typically have a predetermined clearance between the electronic device and the electronic device support component 300, and thus the alignment of the connector 101 and the connector 400 has been difficult in terms of dimensions.

The mechanism of conventional products has, however, been based on the assumption that the electronic device is manually inserted and advanced. After the position is corrected, therefore, by stopping the insertion of the electronic device and moving manually the electronic device slightly in vertical and horizontal directions for a fine adjustment once the connectors collide with each other as described above, it is still possible to restart the insertion and allow the alignment bosses of the connector 101 to fit into the recesses of the connector 400.

This means that the prior art requires interrupting the insertion of the electronic device to manually fine adjust the position.

It is expected that many mechanisms will in the future be employed to automatically feed the electronic device by the electronic device connecting apparatus. Automatic feeder mechanisms assuming the adoption of the prior art electronic devices would be hampered by the difficulty of providing a mechanism and controlling it to perform a fine adjustment as manually done as described above, or, if possible, would require complex mechanisms and control.

SUMMARY OF THE INVENTION

It is an object of the present invention to provide an electronic device and the corresponding electronic device connecting apparatus that do not require interrupting the insertion and a fine adjustment of the position, for example, by manual operation when the electronic device is inserted into the electronic device connecting apparatus, and that eliminate needs of complex mechanisms and control for mechanisms automatically feeding the electronic device by the electronic device connecting apparatus. It is another object of the present invention to provide an electronic device and information processing apparatus that can provide protection for an electronic device against shock and vibration after it is inserted.

To achieve the above objectives, an electronic device according to the invention comprises an enclosure including an electronic component, and a connector device electrically connected to the electronic component and disposed on a side of the enclosure, wherein the connector device has a connector device guide formed on each of two outer sides thereof, and the enclosure has an enclosure guide, which is generally continuous with the connector device guide, formed on each of two outer sides thereof.

An information processing apparatus according to the invention comprises an electronic device, and electronic device connecting apparatus to which the electronic device is connected, wherein the electronic device comprises an enclosure including an electronic component, a first connector device electrically connected to the electronic component and disposed on a side of the enclosure wherein the first connector device has a connector device guide formed on each of two outer sides thereof, and an enclosure guide, which is generally continuous with the connector device guide, on each of two outer sides of the enclosure, and wherein the electronic device connecting apparatus comprises a second connector device to which the first connector device is connected, and an electronic device guide matching the connector device guide with the enclosure guide.

The information processing apparatus according to the invention further comprises an opening to which an electronic device is mounted, wherein the apparatus further comprises a second connector to which a first connector of the electronic device is connected, and a guide support supporting both the connector device guide formed on each of two outer sides of the first connector device and the enclosure guide generally continuous with the connector device guide.

A connector according to the invention is mounted to the electronic device, and comprises a connector device guide that is formed on each of two sides thereof and that is generally continuous with the enclosure guide formed on each of two outer sides of the enclosure of the electronic device, and a connecting section connected to an external connector.

DETAILED DESCRIPTION OF THE PREFERRED EMBODIMENTS (First Embodiment)

An embodiment of the present invention will now be described in detail with reference to the drawings.

Figure 1:
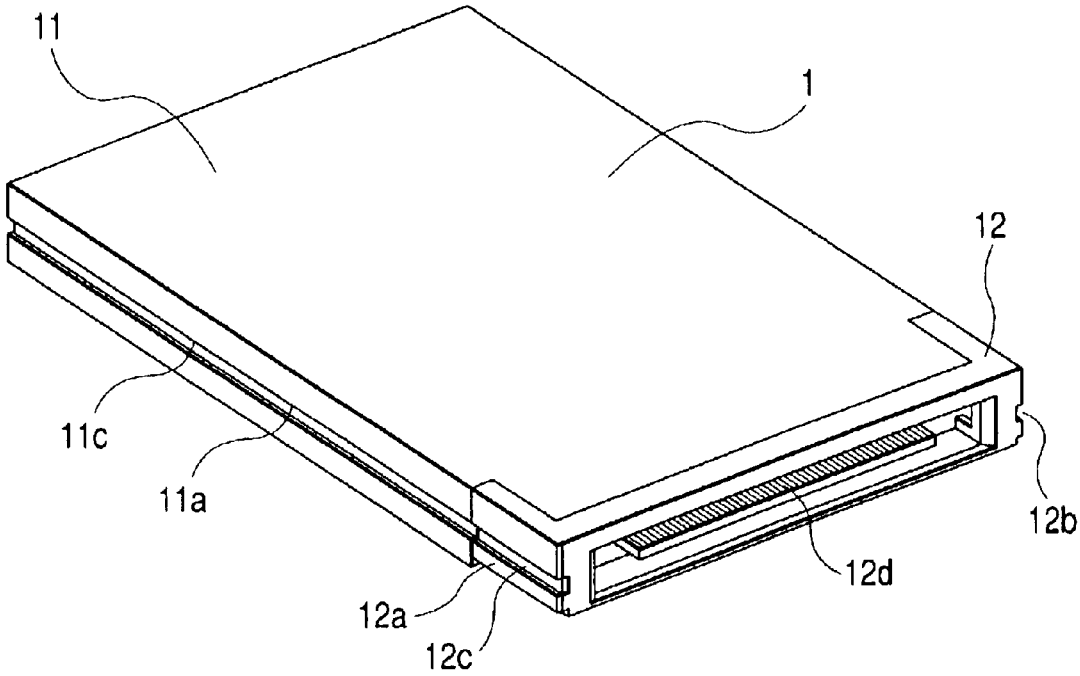
FIG. 1 shows a perspective view of an electronic device according to a first embodiment of the invention.
Figure 2:
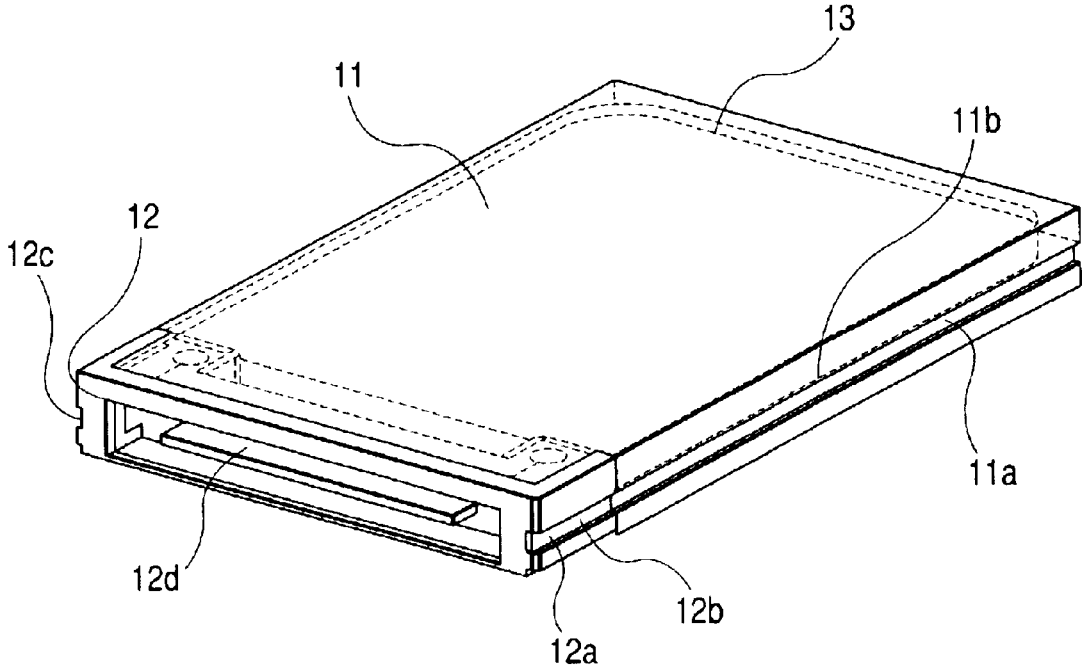
FIG. 2 is a perspective view partially illustrating in perspective an electronic device according to the first embodiment of the invention.

FIG. 1 shows a perspective view of an electronic device according to a first embodiment of the invention, and FIG. 2 is a perspective view partially illustrating in perspective the same device shown in a different direction.

FIG. 1 and FIG. 2 show an electronic device 1, an enclosure 11 of the electronic device 1, a first connector device 12, an enclosure guide 11*a* in the form of a groove and formed on each of two outer sides of the enclosure 11, a right enclosure guide 11*b* representing the enclosure guide 11*a* on the right side of the enclosure 11, a left enclosure guide 11*c* similarly representing the enclosure guide 11*a* on the left side of the enclosure 11, a connector device guide 12*a* in the form of a groove and formed on each of two outer sides of a first connector device 12, a right connector device guide 12*b* representing the connector device guide 12*a* on the right side of the first connector device 12, a left connector device guide 12*c* similarly representing the connector device guide 12*a* on the opposing left side, a connection terminal 12*d* of the first connector device 12, and an electronic component 13 included inside the enclosure 11.

In the above arrangement, the electronic component 13 is included inside the enclosure 11 and its electrical signals are coupled to the connection terminal 12*d* of the connector device 12 by a component (not shown) such as the heat seal. The electronic component 13 may be a hard disk device or semiconductor memory device etc., and because any known types of them may be used, detailed constructions will not be described herein.

The connector device 12 is disposed on a side of the enclosure 11 and provides for connection to an external connector device. The connector device 12 is provided with a connector device guide 12*a* on each of two outer sides thereof, specifically, the right connector device guide 12*b* on the right side and the left connector device guide 12*c* on the opposite side.

The enclosure guide 11*a* on each of two sides of the enclosure 11 is in a shape generally continuous with the connector device guide 12*a*, specifically, the right connector device guide 12*b* is generally continuous with the right enclosure guide 11*b* and the left connector device guide 12*c* is generally continuous with the left enclosure guide 11*c*.

Figure 9:
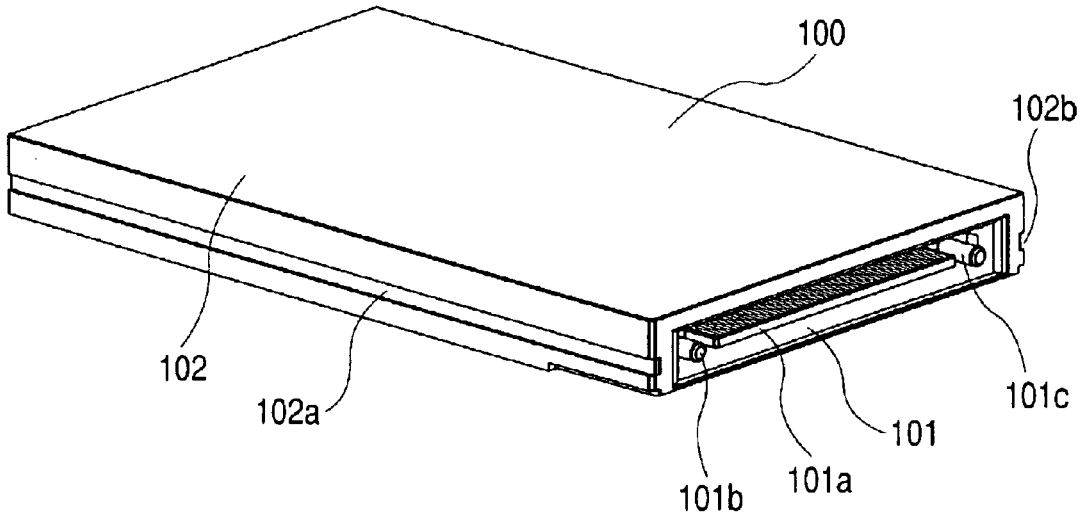
FIG. 9 shows a perspective view of a conventional electronic device.
Figure 10:
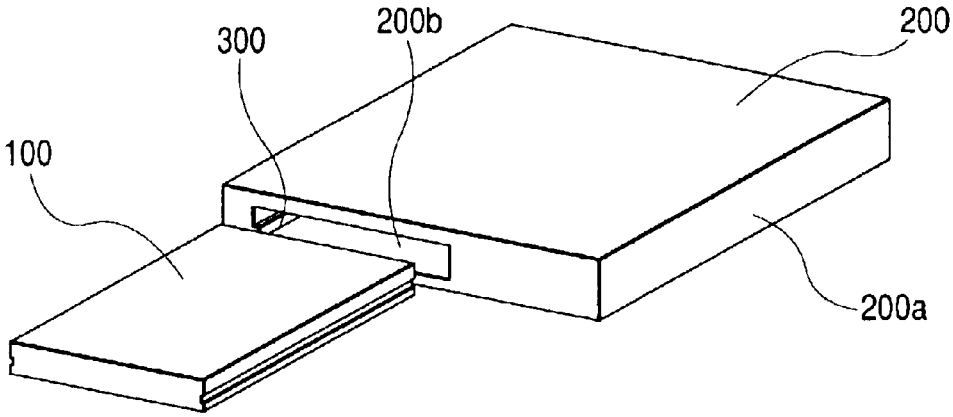
FIG. 10 is a perspective view illustrating an electronic device 100 inserted through a slot of an electronic device connecting apparatus located on a main apparatus.
Figure 11:
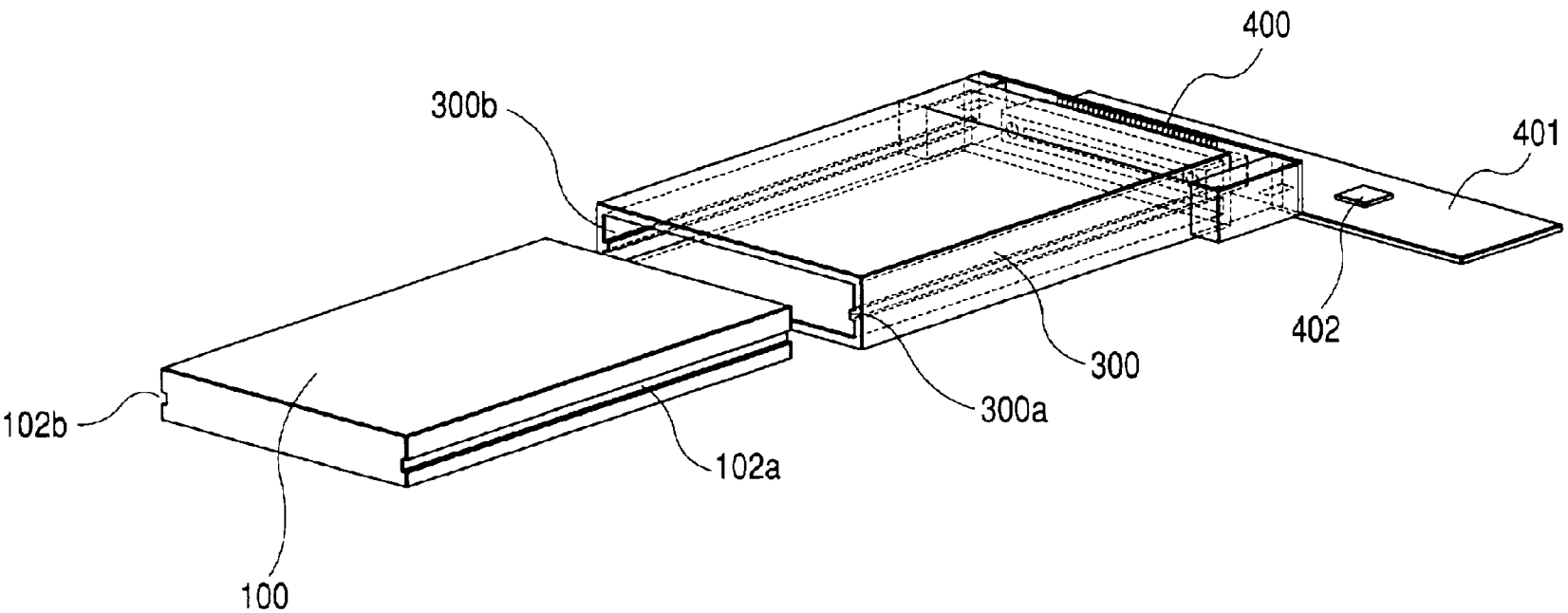
FIG. 11 shows how the electronic device 100 is supported by an electronic device support component 300.
Figure 12:
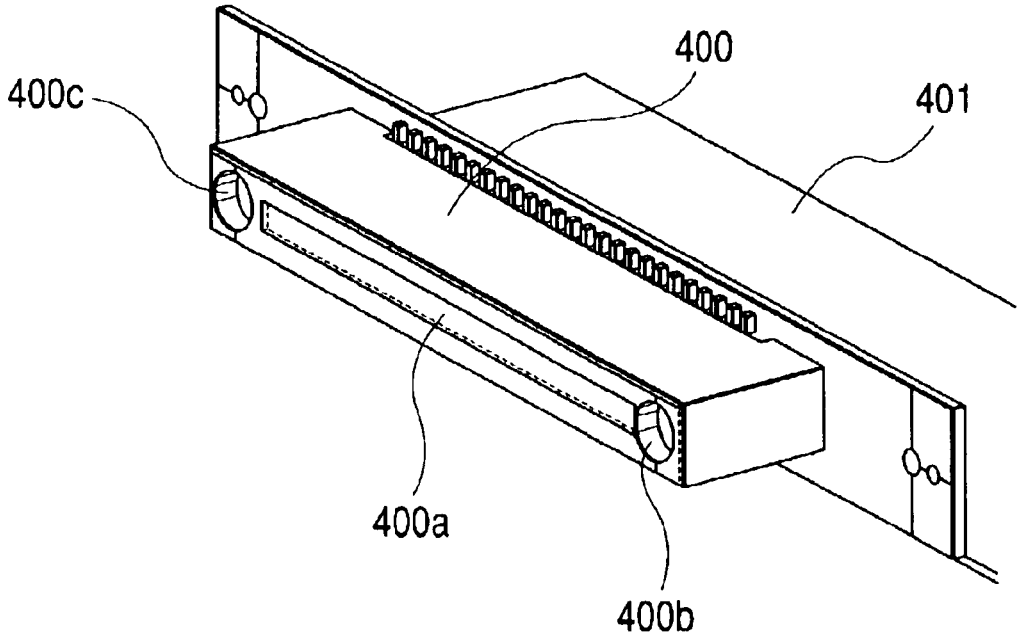
FIG. 12 shows a perspective view of a connector 400 located on an electronic device connecting apparatus 200 and connected to a connector 101 of the electronic device 100.

In a conventional electronic device 100 illustrated in FIG. 9, a connector 101 is smaller in vertical and horizontal outer dimensions than an electronic device enclosure 102, and is constructed so that four sides forming a terminal plane of the connector 101 are not exposed outside the electronic device 100 and four sides thereof are covered by the enclosure 102. As shown in FIG. 10 and FIG. 11, therefore, the connector 101 may not be supported before the connector 101 is connected to the connector 400 after the electronic device 100 is inserted into a slot 200*b* of an electronic device connecting apparatus 200, and thus a right guide 102*a* and left guide 102*b* on either side of an enclosure 102 are supported.

In the electronic device 1 according to the present embodiment, however, the connector device 12 is provided with a connector device guide 12*a* on each of two outer sides thereof, and the enclosure guide 11*a* in a shape generally continuous with the connector device guide 12*a* is formed on each of two sides of the enclosure 11. This enables the connector device guide 12*b* of the connector device 12 to provide support before the electronic device 1 is connected to a second connector device after it is inserted into a slot of an electronic device connecting apparatus so that the position of the first connector device 12 can be more accurately aligned with that of a corresponding connector device in vertical and horizontal directions.

Figure 3:
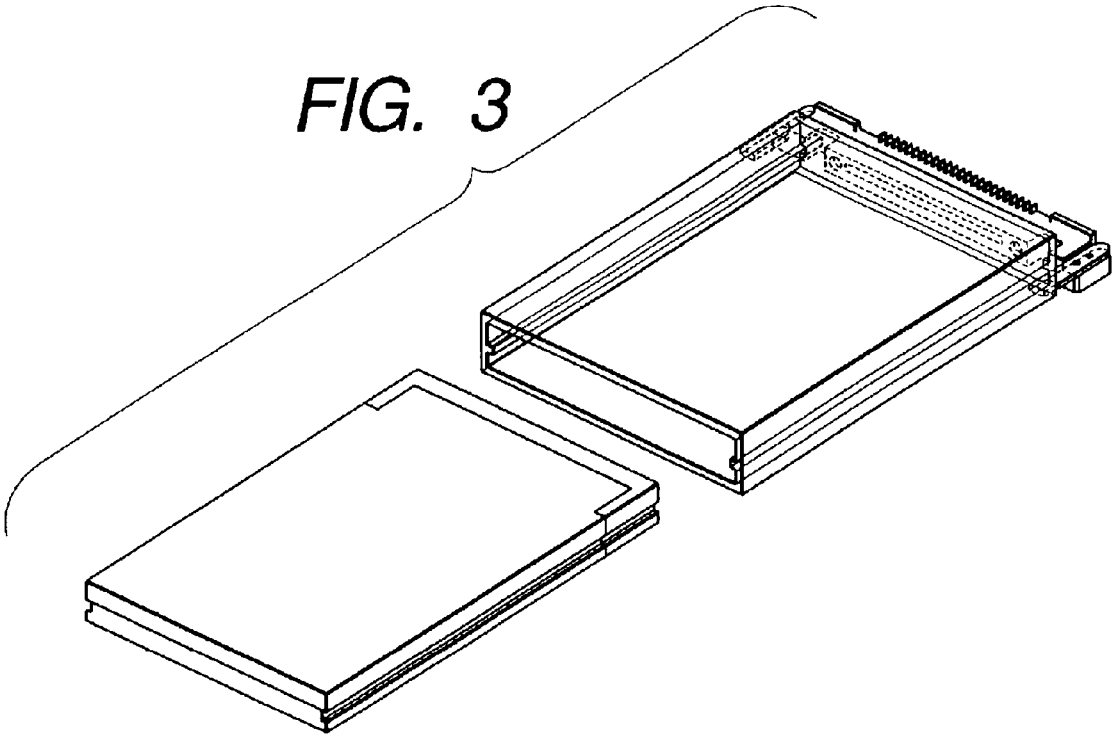
FIG. 3 is a perspective view partially illustrating in perspective an electronic device support that is provided on an electronic device connecting apparatus according to the first embodiment of the invention into which an electronic device is inserted, and illustrating when the electronic device is to be mounted.

FIG. 3 is a perspective view partially illustrating in perspective an electronic device support 301 that is provided on an electronic device connecting apparatus 200, such as a personal computer or workstation etc. schematically shown in FIG. 10, into which the electronic device 1 is inserted, and illustrating when the electronic device 1 is to be mounted.

Guides 300*b* and 300*c* are provided on each of two sides toward an entry of the electronic device support 300, providing a structure that allows the electronic device 1 to be mounted by matching support guides 12*b* and 11*b* of the electronic device 1 with support guides 12*c* and 11*c* respectively.

Figure 4:
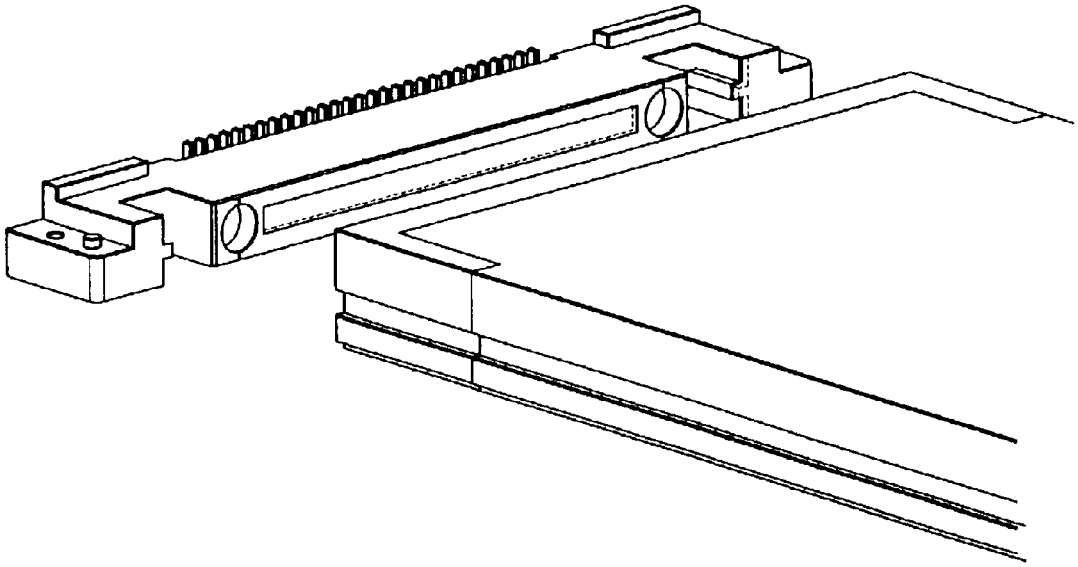
FIG. 4 shows a perspective view of a second connector device located on an electronic device connecting apparatus, to which a first connector device of an electronic device is connected.

FIG. 4 shows a perspective view of a second connector device located on the electronic device connecting apparatus 200, to which the first connector device 12 of the electronic device 1 is connected.

A second connector device has recesses formed on either side of the connector so that it can be connected to the first connector device 12.

The enclosure guide 11*a* and connector device guide 12*a* are vertically (perpendicular in the drawing) offset from the center (downwardly in this embodiment). This avoids the upside-down insertion.

(Second embodiment)

Figure 5:
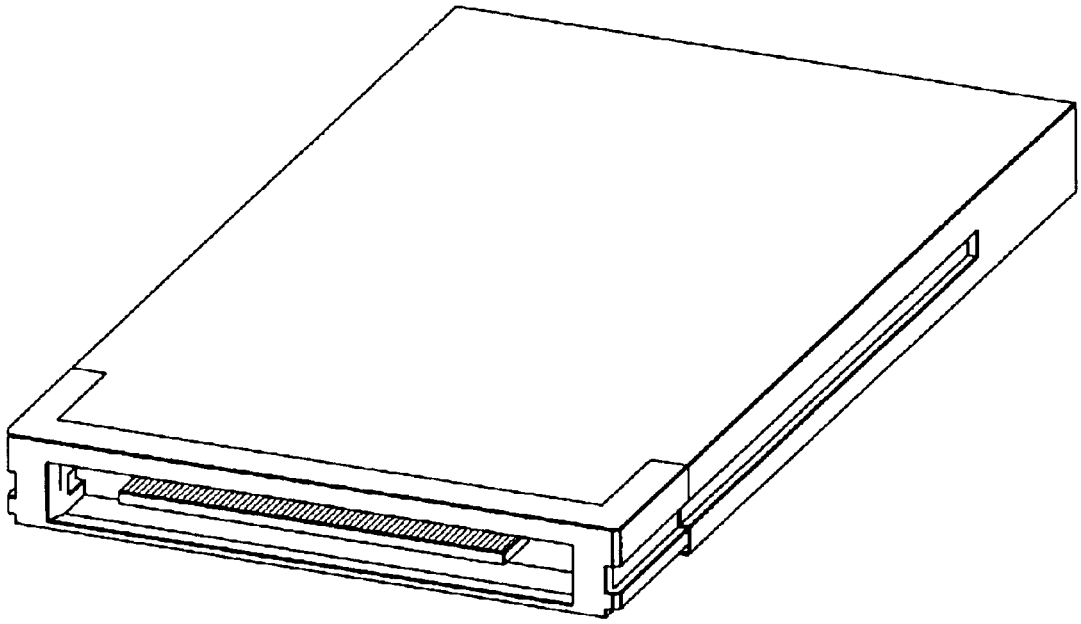
FIG. 5 shows a perspective view of an electronic device according to a second embodiment of the invention.

FIG. 5 shows a perspective view of an electronic device according to a second embodiment of the invention.

While in FIG. 1 the enclosure guide 11*a* on each of two sides of the enclosure 11 extends to the opposite, connector side of the enclosure 11, it is here terminated in part of the way (beyond the center toward the opposite side in this embodiment).

Figure 7:
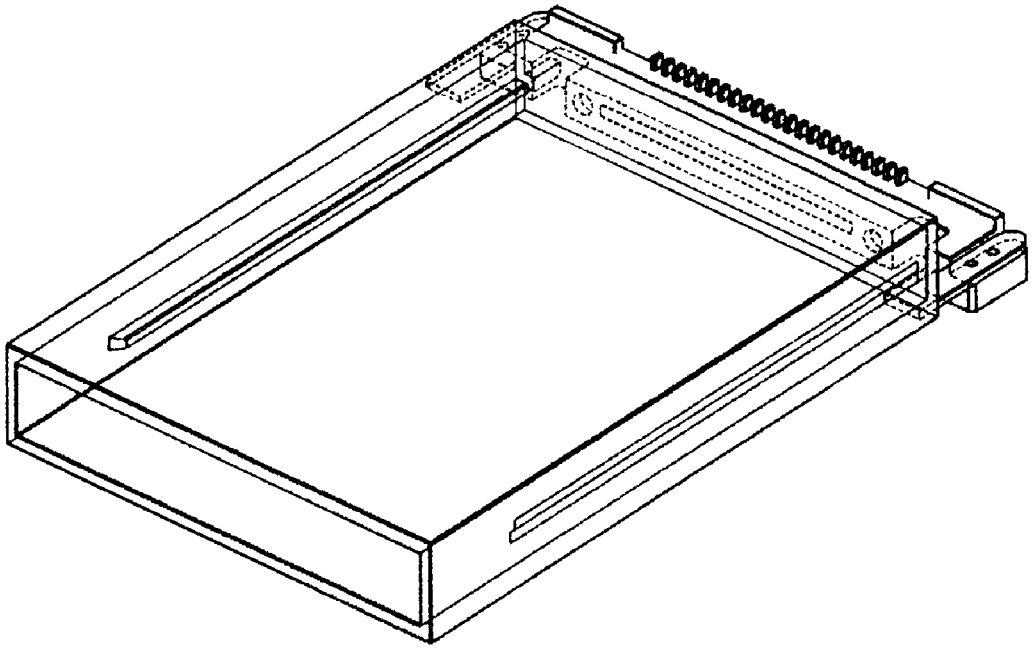
FIG. 7 is a perspective view partially illustrating in perspective an electronic device support to which the electronic device shown in FIG. 5 is mounted.

FIG. 7 is a perspective view partially illustrating in perspective the electronic device support 300 to which the electronic device shown in FIG. 5 is mounted (similarly to the case shown in FIG. 10, it is provided on the electronic device connecting apparatus 200).

As can be seen, the guides 300*b* and 300*c* that may be matched with the enclosure guide 11*a* are not provided on the entry side.

This avoids the accidental insertion from the opposite side of the connector.

(Third embodiment)

Figure 6:
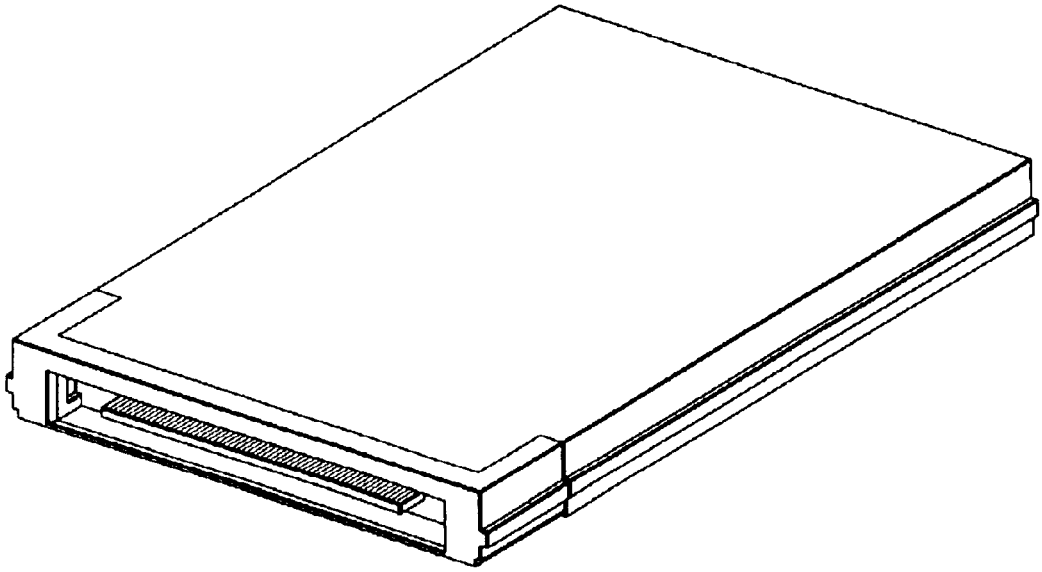
FIG. 6 shows a perspective view of an electronic device according to a third embodiment of the invention.

FIG. 6 shows a perspective view of an electronic device according to a third embodiment of the invention.

While in FIG. 1 the enclosure guide 11*a* on each of two sides of the enclosure 11 and the connector device guide 12*a* are in a shape of a recess, they are formed as a ridge in this embodiment.

It is apparent that guides of the electronic device support 300 of the electronic device connecting apparatus 200 are formed as a recess corresponding to the ridge modified from a recess.

The length may be shortened as shown in FIG. 5.

(Fourth embodiment)

Figure 8:
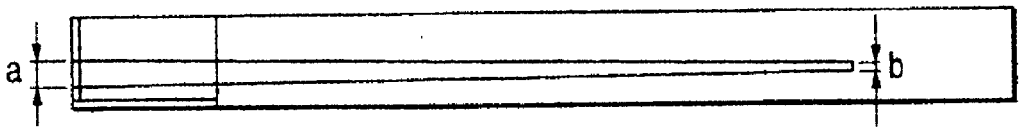
FIG. 8 shows a perspective view of an electronic device according to a fourth embodiment of the invention.

FIG. 8 shows a perspective view of an electronic device according to a fourth embodiment of the invention.

While in FIGS. 1, 5 and 6 the enclosure guide 11*a* on each of two sides of the enclosure 11 and the connector device guide 12*a* are constant in width, they have grater width on the connector side and narrower width on the opposite side (a>b).

This facilitates the insertion of the electronic device 1.

In this case, the electronic device support 300 of the electronic device connecting apparatus 200 is constant in width. Narrower width on the opposite side of the connector of the enclosure guide 11*a* on each of two sides of the enclosure 11 and the connector device guide 12*a* therefore assures the retention of the electronic device 1.

It is apparent that the connector devices described from the first to fourth embodiments are a separate unit from an enclosure of an electronic device. Furthermore, each connector apparatus is mounted on the enclosure of the electronic device and secured by screws, fasteners and soldering in each embodiment.

It is further apparent that information is sent and received between the electronic device and the electronic device connecting apparatus.

As described above, connection is assured between a connector of an electronic device and a connector of an electronic device support according to the invention so that loads and/or stresses on associated components with the connectors may be reduced.

In addition, the invention facilitates the insertion of the electronic device into an opening in the electronic device support, and may also avoid the accidental insertion of the electronic device.

As described above, connectors may properly be connected to each other according to the present invention.

What is claimed is:

1. An electronic device comprising:

an enclosure including an electronic component; and a connector device electrically connected to said electronic component and disposed on a side of said enclosure, wherein said connector device has a connector device guide formed on each of two outer sides thereof, and said enclosure has an enclosure guide, which is generally continuous with said connector device guide, formed on each of two outer sides thereof, and a width of said connector device guide is substantially the same as a width of said enclosure guide.

2. The electronic device according to claim 1, wherein said connector device guide and said enclosure guide are vertically offset from the center in either direction.

3. The electronic device according to claim 1, wherein said connector device guide and said enclosure guide are guides in a shape of a ridge or recess.

4. The electronic device according to claim 1, wherein said connector device guide and said enclosure guide have a width that is not identical on either side.

5. The electronic device according to claim 1, wherein said electronic device is a hard disk device or memory device.

6. A connector mounted to an electronic device comprising:

a connector device guide that is formed on each of two sides thereof and that is generally continuous with an enclosure guide formed on each of two outer sides of an enclosure of the electronic device, with a width of said connector device guide being substantially the same as a width of the enclosure guide; and a connecting section connected to an external connector.

7. The connector according to claim 6, wherein said connector device guide is not constant in width.

* * * * *